United States Patent [19]

Laine

[11] Patent Number: 4,768,730

[45] Date of Patent: Sep. 6, 1988

[54] DISPLACING DEVICE FOR REELING DRUM OF A PAPER MACHINE

[75] Inventor: Paavo Laine, Tampere, Finland

[73] Assignee: Oy Tampella AB, Tampere, Finland

[21] Appl. No.: 16,938

[22] Filed: Feb. 20, 1987

[30] Foreign Application Priority Data

Apr. 3, 1986 [FI] Finland ..... 861436

[51] Int. Cl.[4] ..... B65H 19/24

[52] U.S. Cl. ..... 242/58.6; 414/684; 414/748

[58] Field of Search ..... 242/58.6, 56 R, 79; 414/910, 911, 684, 748, 745

[56] References Cited

U.S. PATENT DOCUMENTS

| | | | |
|---|---|---|---|
| 478,731 | 7/1892 | Bancroft | 414/911 X |
| 1,026,369 | 5/1912 | Robeson | 242/58.6 |
| 1,159,561 | 11/1915 | Woodside | 414/748 |
| 3,049,314 | 8/1962 | Criger | 242/79 |
| 3,586,253 | 5/1969 | Gübank . | |
| 3,610,545 | 10/1971 | Reifenhäuser | 242/65 X |
| 4,462,749 | 7/1984 | Crocker et al. | 414/748 |
| 4,487,545 | 12/1984 | Schonmeier | 414/911 X |

FOREIGN PATENT DOCUMENTS 420079 4/1979 Sweden .

*Primary Examiner*—Stuart S. Levy
*Assistant Examiner*—Katherine Matecki
*Attorney, Agent, or Firm*—Banner, Birch, McKie & Beckett

[57] ABSTRACT

The invention relates to a device for displacing a reeling drum of a web-like material from a store on a primary fork of the reeler of a paper machine or the like. The device comprises a displacing arm mechanism mounted pivotably around a stationary horizontal shaft and arranged to grip an empty reeling drum positioned in the store in an upper position and to deliver the reeling drum in a lower position on the primary fork. In order to provide a simple device reliable in operation and easy to automate, the displacing mechanism comprises a lever and a hook. The hook is journalled displaceably on a journal point provided in the lever so as to be displaced during the pivoting movement of the displacing mechanism.

4 Claims, 4 Drawing Sheets

DISPLACING DEVICE FOR REELING DRUM OF A PAPER MACHINE

Figure 1:
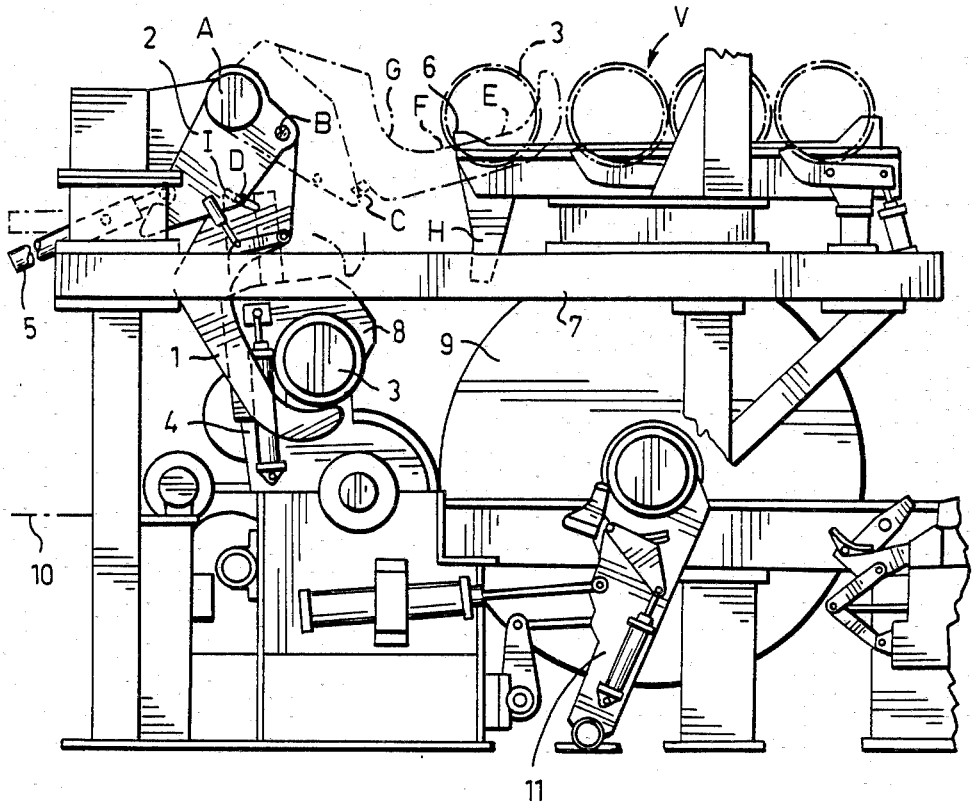

The invention relates to a device for displacing a reeling drum of a web-like material from a store on a primary fork of a reeler of a paper machine or the like, comprising a displacing arm mechanism mounted pivotably around a stationary horizontal shaft and arranged to grip an empty reeling drum positioned in the store in an upper position and to deliver the reeling drum to the primary fork in a lower position.

The displacement of a reeling drum from a store, such as a drum rack, on the primary fork of a reeler is carried out as a continuous step in connection with paper making in particular.

The reeling drums of reelers widely used at present are displaced on the primary fork of the reeler by means of a derrick and a hoist. The movements of the hoist are usually controlled manually from the operating side of the machine. However, this solution, practicable as such, has the following disadvantages. The drum and the structures may be damaged in spite of the professional skill and carefullness of the operator. In addition, the hoist is needed in connection with each exchange. Further, the operation cannot be automated. Often there is also a lack of storage space for empty reeling drums.

Various rack solutions positioned partly or wholly above the reeler have been suggested for the elimination of the above disadvantages. Such racks provide storage space for several drums, and the object of the solutions suggested has been to displace the drum from the rack to the primary fork of the reeler without the use of a hoist.

There are two main types of prior solutions. In solutions of the first type, the primary fork is made sufficiently long and such in structure that the drum can be rolled from the rack directly into a jaw displaceable on the long fork. In solutions of the second type the displacement of the drum from the rack on the primary fork is carried out by means of different kinds of displaceable displacing mechanisms. Such displacing mechanisms are often formed by hook structures of different types. The structures disclosed in U.S. Pat. Nos. 3,586,253, and 3,610,545 and Swedish Published Specification No. 420,079 may be mentioned as examples of prior solutions.

A drawback of the first main type is that the long fork requires plenty of room and makes it necessary to resort to compromises unsatisfactory in view of the reeler. One problem with the second main type is the space required by the hook itself and the use thereof; further, it has turned out to be difficult to find a solution by means of which the drum could be placed smoothly on the fork so that the drum is disengaged from the hook and the hook does not hamper subsequent operations. In known solutions the path of the hook and the drum is a circular arc from beginning to end, because the hook structure is journalled on a fixed point. Therefore the hook structure and the primary fork have to be constructed so that the drum hits the fork when it moves along an arched path. In addition, the hook has to be such in shape that it is able to detach itself from the drum after it has delivered the drum on the fork. This usually results in problems with the structures of the reeler and the primary fork, because, for instance, it is not possible to immediately lift up the fork after the drum has been put down on horizontal rails. Furthermore, the hook structure often severely hampers the operations of the reeler, such as the web feeding and reeling drum exchange, because the hook has to be such in shape that it is able to detach itself from the drum.

The object of the invention is to provide a device by means of which the above disadvantages can be eliminated. This is achieved by means of the device according to the invention which is characterized in that the displacing arm mechanism comprises a lever and a hook, and that the hook is mounted displaceably on a journal point arranged in the lever so as to be displaced during the pivoting movement of the displacing arm mechanism.

The device according to the invention is advantageous mainly in that it is simple, which leads to low manufacturing and operating costs. The operation of the device according to the invention can be automated in a simple way. Further, the device according to the invention does not in any way disturb the operations of the reeler, because the hook does not require plenty of room in the direction of the machine. As a result, it is possible to construct the reeler and the primary fork in a manner as purposeful as possible in view of the operation of the reeler. The journal of the hook can be ball-shaped, so that when the drum meets the primary fork, it can be led in the transverse direction of the machine. A further advantage is that the hydraulic cylinder supplying power to the device can be positioned in a free space with respect to the operations of the reeler.

Figure 2:
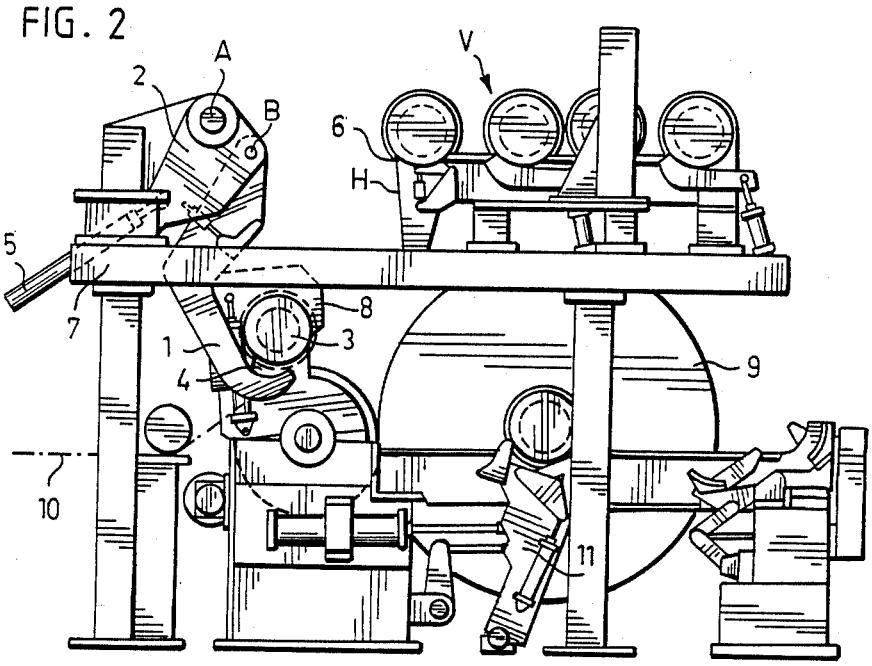
Figure 3:
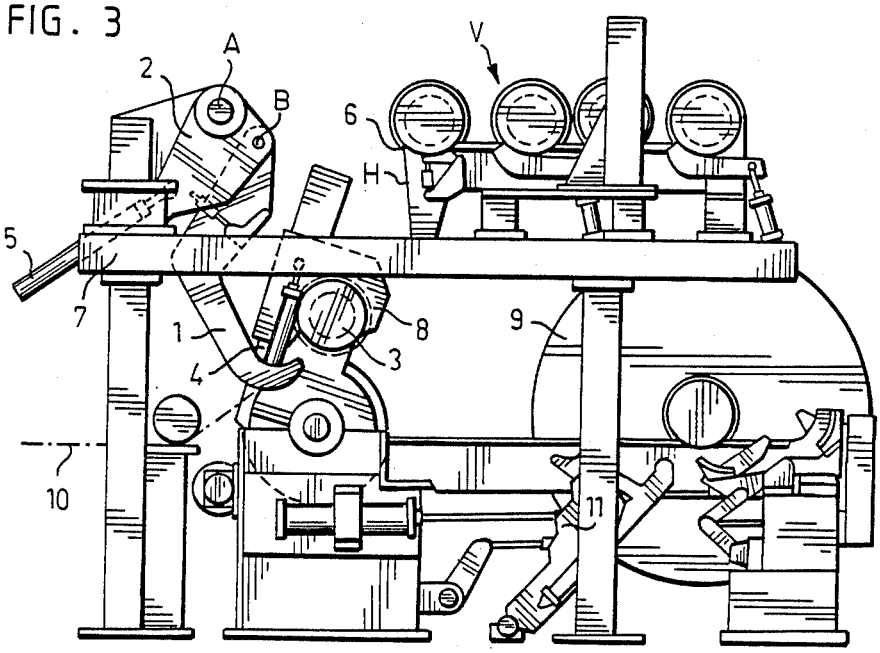
Figure 4:
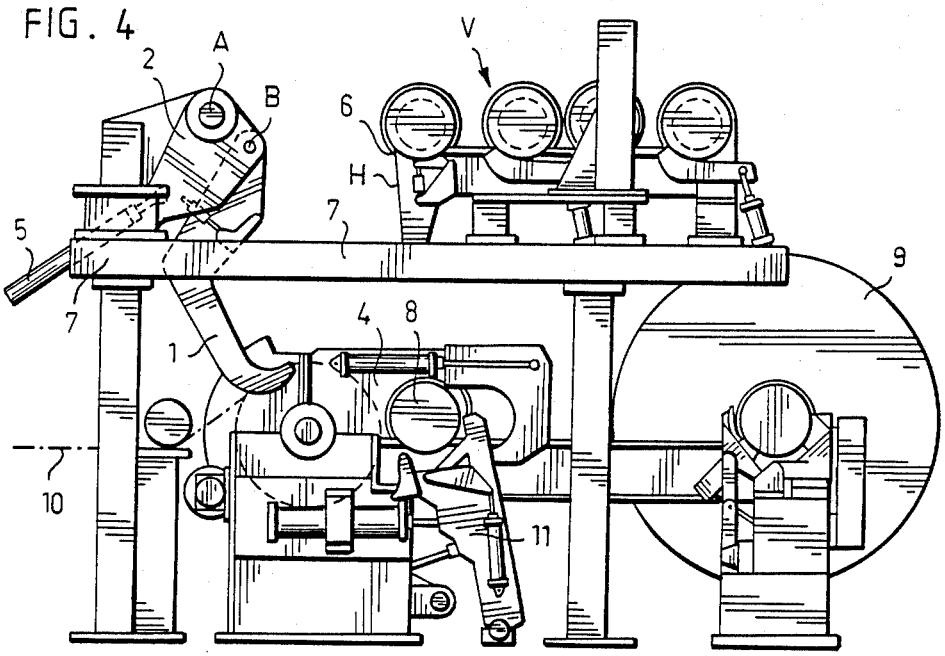
Figure 5:
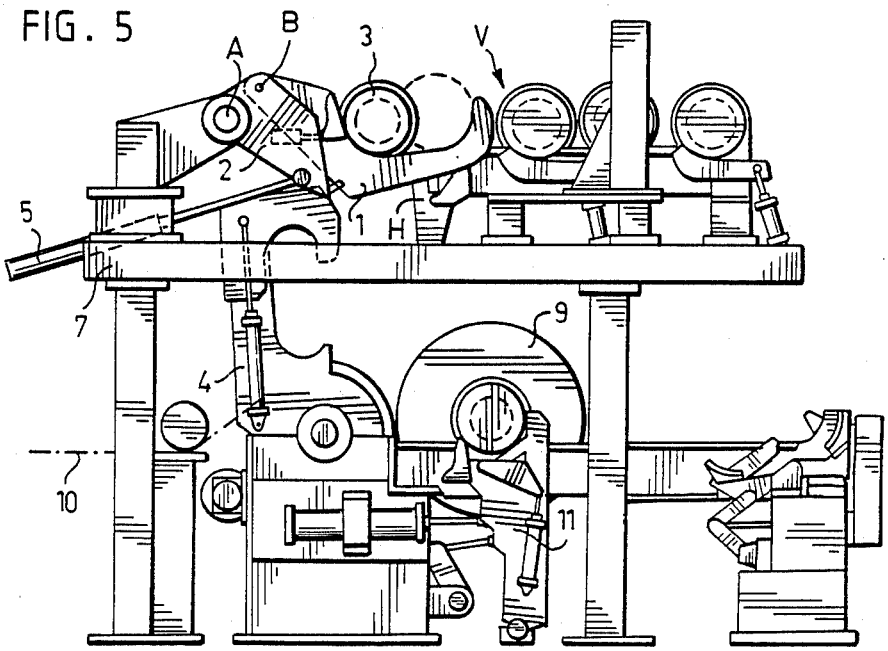
Figure 6:
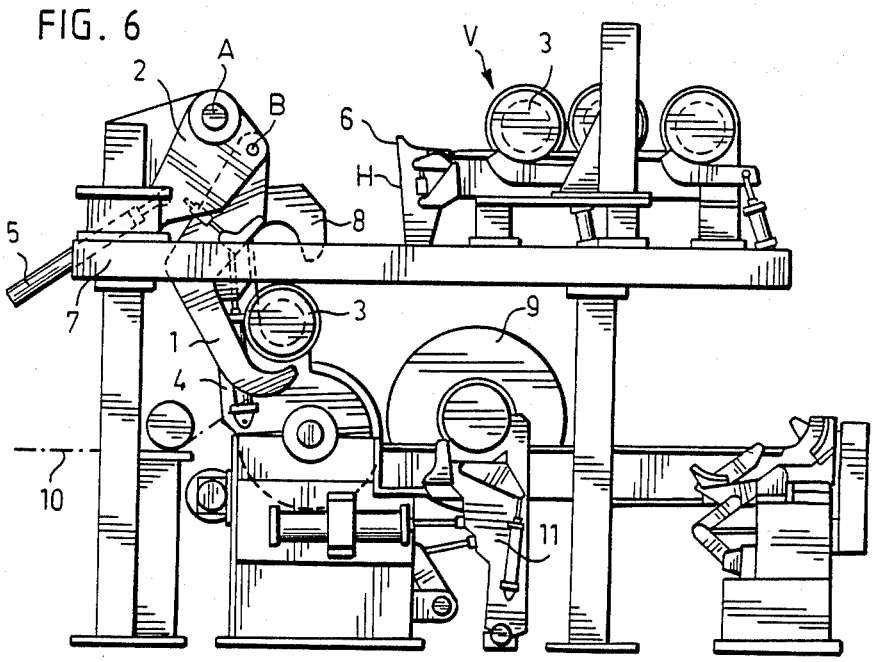
Figure 7:
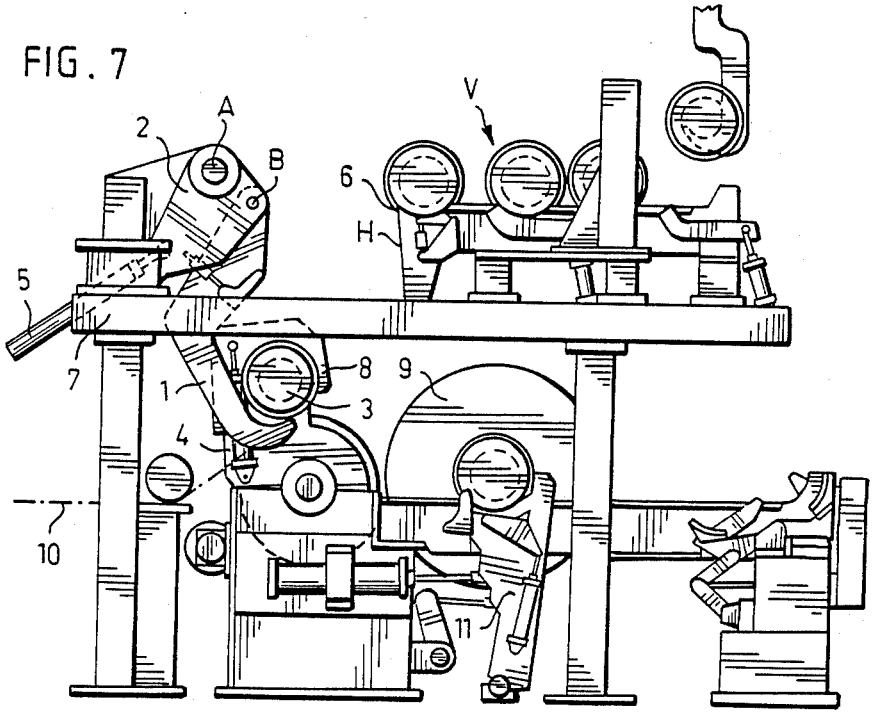

The invention will be described in the following by means of a preferred embodiment shown in the attached drawings, wherein FIG. 1 is a general side view of a device according to the invention, FIG. 2 illustrates the device of FIG. 1 when the reeling drum is in a position ready to be taken into use, FIG. 3 illustrates the device of FIG. 2 when the reeling drum is being exchanged, FIG. 4 illustrates the device of FIGS. 1 to 3 when the primary fork is being detached from the drum, FIG. 5 illustrates the device of FIGS. 1 to 4 when a new drum is being picked up, FIG. 6 illustrates the device of FIGS. 1 to 5 when a new drum is being displaced on the primary fork, and FIG. 7 illustrates the device of FIGS. 1 to 6 when the drum is on the primary fork waiting for a previous drum to become filled.

FIG. 1 shows the device according to the invention on an enlarged scale so that the different details are clearly visible. In FIGS. 2 to 7, the device according to the invention is shown on a smaller scale at the different stages of the operation of the device.

In the example of the figures, a reeling drum 3 intended for the reeling of a web-like material, such as a paper web, is displaced from a store V to a primary fork 4 by means of a displacing arm mechanism mounted pivotably around a stationary horizontal shaft A. The displacing arm mechanism is thereby arranged to grip an empty reeling drum 3 positioned first in the store V. Correspondingly, the displacing arm mechanism is in the lower position arranged to deliver the drum to the primary fork 4.

According to the invention the displacing arm mechanism comprises a hook 1 and a lever 2. The whole combination is arranged to be pivoted around the shaft A. The hook 1 is mounted displaceably on the lever 2 at a point B, and the hook and the lever are in engagement with each other at a point C. The hook 1 is thus journalled on a point which is displaced together with the pivoting movement of the displacing arm mechanism. By virtue of this solution, the path of the hook 1 is a circular arc only up to a certain point.

One important aspect of the device according to the invention is that the circular movement of the point portion of the hook 1 is prevented at a predetermined point. Because of the journalling between the hook 1 and the lever 2, the pivoting movement of the lever 2 and the journal point B around the shaft A can continue, even though the point portion of the hook 1 is prevented from moving along the circular path around the shaft A. The position of the lever 2 relative to the hook 1 is arranged to change during the movement of the displacing mechanism around the shaft A from an upper position to a lower position while the circular movement of the point portion of the hook 1 with the lever 2 is prevented. Since the pivoting movement of the lever is still continued after the circular movement of the point portion of the hook 1 is stooped, the point portion of the hook 1 is lowered substantially in parallel with surface which stops the circular movement of the point portion of the hook 1. The lowering of the point portion of the hook 1 is continued at least until the pivoting movement of the point portion of the hook 1 with the lever is prevented.

Theoretically speaking, the embodiment shown in the figures represents a situation in which the relative circular movement of the lever 2 after the stopping of the circular movement of the point portion of the hook 1 causes horizontal and vertical movement components to occur at the journal point, the vertical components being utilized in such a manner that the movement of the point portion of the hook 1 along a circular arc from the upper position towards the lower position is prevented by means of the drum 3, which is supported by the point portion of the hook 1. This is because the circular movement of the point portion of the hook is stopped when the journal box of the drum supported by the point portion of the hook meets the front surface of the primary fork 4. As mentioned above, the lever 2 and the journal point B, however, continue their circular movement around the shaft A. Thereby the engagement between the hook 1 and the lever 2 is loosened at the point C, i.e. the relative position of the lever 2 and the hook 1 begins the change. When the lever 2 moves on, the downward movement component of the journal point B is transmitted to the point portion of the hook 1 supporting the drum 3, and the drum 3 is displaced smoothly down to the bottom of the primary fork in parallel with the front surface thereof. The downward movement of the hook 1 is, naturally, arranged so that the hook is able to detach itself from the drum delivered to the primary fork. The movement of the hook 1 and the lever 2 with respect to each other and, as a consequence, also the downward movement of the hook, is limited by limiters, in FIG. 1 a hole D provided in the hook 1 and a counter element provided on the lever 2, such as a pin extending into the hole. The movement is thus limited between two predetermined extreme positions, and the limiters may, of course, be any known limiter solutions in place of a hole and a pin. When the downward movement of the point portion of the hook is stopped, the point portion is simultaneously detached from the drum and begins again to move along a circular arc together with the lever.

Thus, the path of the journal point B is throughout a circular arc. When the drum supported by the point portion of the hook 1 meets the primary fork, the point portion of the hook begins to move in the direction of the front surface of the primary fork 4, while the lever 2 and the point B continue to move along a circular path. The point portion of the hook 1 and the drum 3 supported thereby move in the direction of the front surface of the primary fork 4 downwards over a distance determined by the hole D provided in the hook 1, during which movement the drum 3 is lowered on the bottom of the primary fork, and the point portion of the hook is detached from the drum. After this detachment the point portion of the hook as well as the entire hook begins again to move along the circular path together with the lever 2 when the pin comes into contact with the edge of the hole, thus preventing the hook and the lever from moving with respect to each other.

The device according to FIGS. 1 to 3 operates in principle the following way. When a new reeling drum is needed in the reeler, it is displaced thereto from the drum store V by means of the displacing arm mechanism comprising the hook 1 and the lever 2. This initial situation is shown step by step in FIGS. 2 to 4. A hydraulic cylinder 5 supplies operating power to the displacing arm mechanism. The mechanism is pivoted around the shaft A to the upper position shown in FIG. 5. This position is also shown in FIG. 1 by broken lines. In this position the mechanism meets the drum 3 positioned in the front portion of the drum store V at a point E. The mechanism moves on along its path until the drum 3 to be picked up is able to roll over a point 6 along a surface F of the hook to a bottom part G under the influence of gravity. When the mechanism is thereafter pivoted around the shaft A in the opposite direction, the drum 3 rolls along the surface F of the hook and the surface of a counter element H up to the point portion of the hook. The drum 3, which is supported by the hook and which can be passed between body beams 7, reaches the point portion of the hook before the counter surface of the counter element H terminates. The drum supported on the point portion of the hook 1 is passed towards the primary fork 4 by means of the above-mentioned mechanism 1, 2 and the hydraulic cylinder 5. The movement is thereby a circular movement the centre of which is the shaft A. An upper jaw 8 of the primary fork 4 is at this stage in the upper position shown in FIG. 6, which position is also shown in FIG. 1 by broken lines.

When the drum meets the front edge of the primary fork 4, it is prevented from moving along the circular path. Of course, the corresponding movement of the point portion of the hook 1 is thereby also prevented. This position is shown in FIG. 6 and by a continuous line in FIG. 1. Because the lever 2 continues said circular movement, the point B also continues the same movement, whereby the relative position of the lever and the hook is changed and the point portion of the hook is displaced downwards, as mentioned above. Accordingly, the drum supported by the point portion of the hook is displaced downwards along the front surface of the primary fork towards the bottom of the fork. Due to the downward movement component acting on the hook, the drum and the point portion of the hook supporting the drum are displaced downwards, the point portion of the hook is detached from the drum, and begins again to follow the circular path around the shaft A of the lever 2. The extent of the downward movement of the point portion of the hook depends on the length of the hole D formed in the hook, as mentioned above. Finally, the drum is locked in place in the primary fork by displacing the upper jaw 8 downwards into a position shown by a continuous line in FIG. 1 and FIG. 7. At the following stage the operation continues beginning from the situation shown in FIG. 2, etc.

When a drum 9 on which paper, board or some other material is reeled reaches a sufficient size, the web 10 is led on a new drum displaced on the primary fork as described above. A drum supported by a secondary fork 11 is removed, whereafter the drum 3 positioned on the primary fork 4 is displaced on the secondary fork 11, and the primary fork returns to its upper position. Thereafter the displacing arm mechanism 1, 2 is ready to displace a new drum to the primary fork. The stages of the displacement of the drums from the primary fork on the secondary fork appears from FIGS. 2 to 5 in particular.

The above embodiment is by no means intended to restrict the invention, but the invention can be modified within the claims in various ways. Accordingly, it is self-evident that the device according to the invention or the parts thereof do not need to be exactly similar to those shown in the figures, but other kind of solutions are possible as well. Further it is to be understood that the device is by no means restricted to be used in connection with a paper machine, but the device can be used for reeling any web-like material.

What is claimed is:

1. A device for displacing a reeling drum for a web-like material from a store to a primary fork of a reeler of a paper machine or the like located below the store, the device comprising a frame having a horizontal shaft and a displacing arm mechanism mounted pivotable around the horizontal shaft, the displacing arm mechanism cradling an empty reeling drum in the store and delivering the reeling drum to the primary fork, the displacing arm mechanism comprising a lever mounted pivotably on the horizontal shaft, a hook mounted pivotably on a journal point of the lever, and control means for controlling relative pivoting of the hook and the lever in two stages, a first stage in which a point portion of the hook and the journal point of the lever pivot together in concentric circular paths around the horizontal shaft, and a second stage in which the point portion pivots around the journal point and translates substantially vertically without pivoting in a circular path around the horizontal shaft.

2. A device according to claim 1, wherein the control means comprises a surface of the primary fork which prevents circular movement of the point portion of the hook around the horizontal shaft when the drum supported by the hook contacts the surface so the hook pivots around the journal point and the point portion of the hook translates substantially downwardly parallel to the surface.

3. A device according to claim 2, wherein the control means further comprises limiting means disposed on the leveer and the hook for limiting the relative movement of the lever and the hook with respect to each other between predetermined extreme positions to thereby limit the downward movement of the point portion of the hook.

4. A device according to claim 1, wherein the journal of the hook is ball-shaped.

* * * * *